US006887411B2

(12) United States Patent
Osaka et al.

(10) Patent No.: US 6,887,411 B2
(45) Date of Patent: May 3, 2005

(54) METHOD FOR PRODUCING POLYESTER BLENDED YARN

(75) Inventors: Hiroyuki Osaka, Ehime (JP); Hideki Beppu, Ehime (JP); Kenji Iwashita, Ehime (JP)

(73) Assignee: Teijin Limited, Osaka (JP)

( * ) Notice: Subject to any disclaimer, the term of this patent is extended or adjusted under 35 U.S.C. 154(b) by 306 days.

(21) Appl. No.: 10/204,535

(22) PCT Filed: Dec. 11, 2001

(86) PCT No.: PCT/JP01/10854

§ 371 (c)(1),
(2), (4) Date: Aug. 22, 2002

(87) PCT Pub. No.: WO02/50350

PCT Pub. Date: Jun. 27, 2002

(65) Prior Publication Data

US 2003/0052432 A1 Mar. 20, 2003

(30) Foreign Application Priority Data

Dec. 20, 2000 (JP) ..... 2000-386546
Jan. 12, 2001 (JP) ..... 2001-004786
Feb. 8, 2001 (JP) ..... 2001-031995

(51) Int. Cl.[7] ..... D01F 6/62; D02G 3/02
(52) U.S. Cl. ..... 264/103; 264/171.1; 264/211.14
(58) Field of Search ..... 264/103, 171.1, 264/211.14

(56) References Cited

U.S. PATENT DOCUMENTS 3,927,167 A * 12/1975 Reese ..... 264/103 X
4,153,660 A 5/1979 Reese
4,410,473 A 10/1983 Iohara et al.
4,454,196 A 6/1984 Iohara et al.
5,858,290 A * 1/1999 Oh et al. ..... 264/103
6,723,265 B1 * 4/2004 Osaka et al. ..... 264/103

FOREIGN PATENT DOCUMENTS

JP 58-98418 A 6/1983
JP 58-191211 A 11/1983
JP 60-126316 A 7/1985
JP 7-243144 A 9/1995
JP 8-209442 A 8/1996
JP 09-143826 A 6/1997
JP 11-107089 A 4/1999
JP 2000-054239 A 2/2000

OTHER PUBLICATIONS

International Search Report (Mar. 12, 2002).

* cited by examiner

*Primary Examiner*—Leo B. Tentoni
(74) *Attorney, Agent, or Firm*—Sughrue Mion, PLLC

(57) ABSTRACT

A polyester blended yarn giving a woven or knitted fabric exhibiting a swollen touch and a high grade texture is stably obtained by melt-spinning a polyester including A including a substrate polymer including a polyester and 0.5 to 5.0 percent by weight of a polymer P, and the substrate polymer from an identical spinneret or different spinnerets to obtain the filament group A including the polyester composition A and the filament group B including the substrate polymer, blowing cooling air on the filament groups B and A at a speed of 0.20 to 0.80 m/sec and at a speed of not less than 1.1 times said speed, respectively, to once separately cool and solidify the filament groups B and A, doubling the cooled filament groups, and then taking off the obtained doubled yarn at a speed of not less than 2,500 m/min.

9 Claims, 2 Drawing Sheets

METHOD FOR PRODUCING POLYESTER BLENDED YARN

TECHNICAL FIELD

The present invention relates to a method for producing a polyester blended yarn comprising filament groups having different elongations, respectively, in more detail, to a method for producing a polyester blended yarn, comprising doubling a filament group comprising a composition obtained by adding a different polymer to a polyester with a filament group comprising the polyester and then winding up the doubled yarn, by which the blended yarn having a large elongation difference between the filaments can profitably and stably be produced.

BACKGROUND ART

A method for spinning and blending two or more kinds of filaments having a large heat shrinkage difference therebetween has been known as a method for obtaining a spun blended yarn, and said blended yarn can thermally be treated to give the bulky yarn. As a concrete method for developing the above-described heat shrinkage difference, a method using two kinds of polymers having a viscosity difference, a method using a polymer copolymerized with the third component as one of two kinds of the polymers, and the like have been proposed. However, all of these methods are based on crystal orientation differences due to the differences of molecular structures. Therefore, even when a large heat shrinkage difference has been developed, a sufficiently large elongation difference has still not been developed.

For example, in JP-A 54-82423 (hereunder, JP-A means "Japanese Unexamined Patent Publication") has been proposed a method for melting and extruding a polyester from an identical spinneret, quenching the obtained filaments, dividing the filaments into two groups, imparting an oiling agent consisting mainly of water to one of the obtained filament bundles, imparting an oiling agent having a higher boiling point than that of the water to the other, separately thermally treating both the filament bundles in the same condition, simultaneously drawing the filament bundles, and then blending both the filament bundles. But, since a boiling point difference between the spinning oiling agents is utilized to impart a shrinkage difference (boiling water shrinkage difference) between the filament bundles in this method, the boiling water shrinkage difference between said filament bundles can sufficiently not be enlarged, and the obtained blended yarn has a small shrinkage difference between the filaments. Therefore, the finally obtained woven fabric is poorly swollen, and a satisfiable woven fabric can be obtained.

Additionally, in JP-A 58-191211 has been described a blended yarn characterized by melt-extruding two multifilament yarns from an identical spinning pack, giving a difference between a bundling position for one multifilament yarn and a bundling position for the other multifilament yarn, taking off the multifilament yarns at a take-off speed of not less than 4,500 m/min, developing an air resistance difference on said take-off operation to blend and winding up the yarns, thereby developing a shrinkage difference between both the yarns. However, the elongation difference can sufficiently not be enlarged even by this method, although the boiling water shrinkage difference is enlarged. Therefore, the finally obtained woven or knitted fabric does still not have a satisfiable touch (texture).

Further, in JP-A 8-209442 is described a blended yarn which comprises two filament groups comprising highly shrinkable filaments and low shrinkable filaments whose heat shrinkage factors are different from each other and which have a shrinkage difference of 5 to 25%, wherein the low shrinkable filaments comprise a polyester, and the highly shrinkable filaments comprise a copolymerized polyethylene terephthalate obtained by copolymerizing specific amounts of three kinds of monomers consisting mainly of isophthalic acid and two kinds of hydroxyethoxyphenols. Although surely giving a sufficient shrinkage difference, the copolymerization of the third component does always not mean to develop sufficiently large elongation difference. In addition, It is difficult to say that the obtained blended yarn is a low-cost blended yarn having excellent productivity, and the copolymerized polyethylene terephthalate is inferior in polymerization productivity due to the point of the copolymerization of the third component consisting mainly of the isophthalic acid, and is therefore undesirable.

In JP-A 60-126316 is also described a method for producing a polyester blended yarn, comprising melt-extruding two or more polyester filament groups from an identical spinning pack, using a stepped roller having different surface speeds at an identical rotating speed to develop a spinning speed difference between the two filament groups, taking off the filament groups so that the filament group low in the spinning speed is drawn between the stepped roller and the next roller and so that the filament group high in the spinning speed is not drawn, doubling and interlacing both the filament groups with an interlacing device, and then winding up the blended yarn at a speed of not less than 100 m/min. However, in this method, devices and operation conditions are complicated, and it is difficult to realize a stable operation over a long period. Further, the range of production conditions enabling the practical production of the polyester blended yarn is narrow, and it is difficult to obtain the blended yarn having such a shrinkage difference as sufficiently developing bulkiness after false-twisted.

In JP-A 7-243144 is described a method for imparting water to one filament group among plural melt-extruded filament groups, not imparting water to the other filament group in a non-bundled state, simultaneously allowing both the filament groups to pass through heating cylinders set at not less than 150° C., respectively, taking off the filament groups at a speed of 3,000 to 5,500 m/min, and then doubling and blending the filament groups. In this method, it is difficult to uniformly heat the filament groups traveling at the high speed, and the produced blended yarn has many quality irregularities and does not give a woven fabric having a high commercial value.

On the other hand, as a method for spinning and blending two or more, kinds of filaments having an elongation difference therebetween, in JP-A 57-61716 is described a method for spinning and blending a filament group comprising a mixture obtained by adding a polymethyl methacrylate-based polymer and/or a polystyrene-based polymer to a substrate polymer containing a polyester as a main component, and a filament group comprising the substrate polymer. This method is surely a profitable method, because the blended yarn having a shrinkage difference between the filament groups can be produced from only the usually available polymers by use of a concise spinning device. Additionally, remarkable is the technology that the fine division process of the filament group spun from the mixture obtained by adding a polymer such as the polymethyl methacrylate or the polystyrene to the polyester is different from that of the filament group simultaneously spun from only the polyester, consequently developing a shrinkage difference between both the filament groups.

However, the method has a problem that the filament group is frequently broken to lower the productivity of the filament group, when the filament group is spun and wound up only in conditions described in the method. Thereby, also in the technology that the polymer such as the polymethyl methacrylate-based polymer and/or the polystyrene-based polymer is added to the polyester to develop a physical property difference between the filament group spun from the polymer mixture and the filament group simultaneously spun from only the polyester, devices are further needed for the stable commercial production of the desired blended yarn for a long period.

Further, in JP-A 58-98418 is also described a method for producing the same spun blended yarn as that in the above-described specification. The blended yarn obtained by this method is relatively good at the point of bulkiness, but insufficient at the point of texture (softness, repulsiveness, swelling, and the like). Thereby, the development of a technology for further improving such texture is desired. Additionally, the stability of the production is also insufficient in this method, and the further improvement of the technology is demanded.

DISCLOSURE OF THE INVENTION

The present invention has been invented on the basis of the current states of such the conventional technologies as backgrounds. The first object of the present invention is to provide a method for stably producing a polyester blended yarn which comprises two or more filament groups having different elongations, respectively, has a large elongation difference between said filament groups. The second object of the present invention is to provide a method for producing a blended yarn giving a woven or knitted fabric exhibiting a higher-grade texture than those of conventional fabrics, in addition to the first object. Furthermore, the third object is to provide a method for producing a blended yarn also excellent in post processability, in addition to the above-described first object.

By the researches of the inventors of the present invention, it has been fount that the above-described first object can be achieved by the following three methods. It has also been found that the second and third objects can be achieved by the following first and third methods, respectively.

The first method is a method for producing a polyester blended yarn, characterized by melt-extruding a polyester composition A which comprises a substrate polymer comprising a polyester and 0.5 to 5.0 percent by weight of a polymer P different from the substrate polymer from an identical spinneret or different spinnerets, respectively, to obtain the filament group A comprising the polyester composition A and the filament group B comprising the substrate polymer, once separately cooling and solidifying the filament groups in the following conditions (1), (2), respectively, doubling the filament groups, and then taking off the obtained blended yarn at a speed of not less than 2,500 m/min.

(1) The speed of cooling air blown on the filament group B (BSb): 0.20 to 0.80 m/sec.

(2) The speed of cooling air blown on the filament group A (BSa): $BSa \geqq 1.1 \times BSb$.

The second method is a method for producing a polyester blended yarn, characterized by doubling a filament group A obtained by adding a polymer P to a substrate polymer comprising a polyester and then melting, blending and spinning the mixture with a filament group B comprising the substrate polymer and spun from an identical spinneret or a different spinneret and then winding up the obtained blended yarn, characterized by disposing a bundling device for bundling the filament group A in a range expressed by the following expression.

$$GO < GA \leqq 200 \text{ (cm)}$$

wherein, GO is a distance between the spinneret face and the necking-starting point of the filament group A; GA is a distance between the spinneret face for spinning the filament group A and the bundling device.

Further, the third process is a method for producing a polyester blended yarn, characterized by once cooling a filament group A obtained by adding a polymethyl methacrylate-based polymer having a melt viscosity characteristic represented by the following expression (4) and/or a polystyrene-based polymer having a melt viscosity characteristic represented by the following expression (5) in an amount of 0.3 to 5.0 percent by weight based on a polyester to the substrate polymer comprising the polyester, and then blending, melting and spinning the mixture and a filament group B comprising said substrate polymer and spun from the same spinneret or a different spinneret at a temperature equal to or lower than the glass transition temperatures, doubling the filament groups A and B, and then winding up the obtained blended yarn.

(4) $MVPM \geqq 0.6\ MVPE$ (5) $MVPS \geqq 1.5\ MVPE$

Wherein, MVPM is the melt viscosity (poise) of the polymethyl methacrylate-based polymer; MVPS is the melt viscosity (poise) of the polystyrene-based polymer; MVPE is the melt viscosity (poise) of the polyester polymer.

BEST MODE FOR CARRYING OUT THE INVENTION

Figure 1:
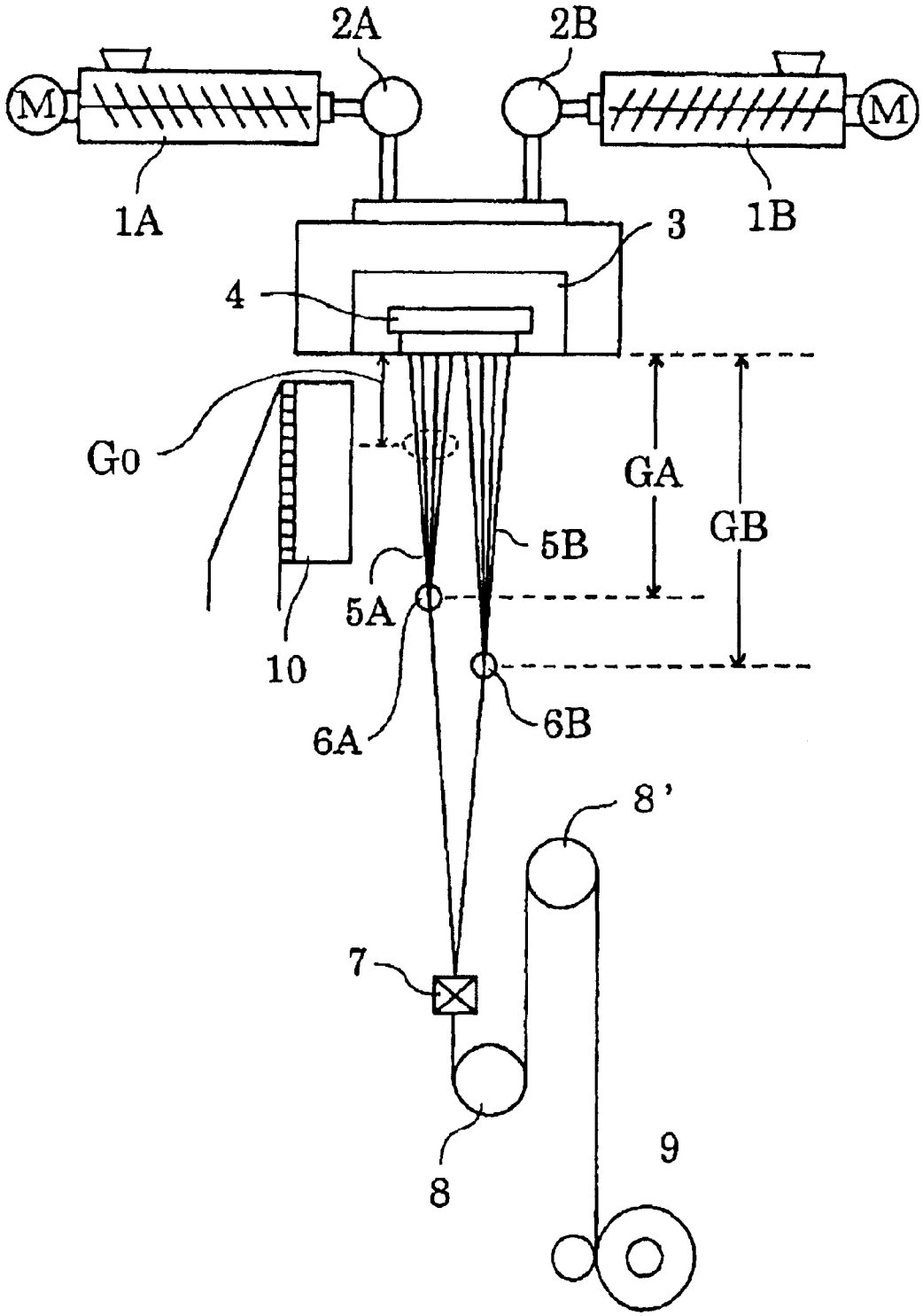
FIG. 1 is a schematic diagram exemplifying a process for carrying out the above-described second method.

Hereinafter, the present invention will be explained in detail. First, the first method will be explained in full.

The substrate polymer comprising the polyester and used in the present invention is a polyester in which not less than 85 percent by mole, preferably not less than 95 percent by mole, especially preferably substantially all of the total repeating units comprise ethylene terephthalate units, and may be copolymerized with the third component excluding terephthalic acid component and ethylene glycol component.

The intrinsic viscosity (measured using a 35° C. o-chlorophenol solution) of such the substrate polymer is suitably ranged from 0.50 to 1.0, especially suitably from 0.55 to 0.70, because the mechanical strengths of the obtained filaments tends to be lowered, when the intrinsic viscosity of the substrate polymer is too small, while the breakage of the yarn is liable to occur in a spinning process, when the intrinsic viscosity is too large. The substrate polyester may further contain known additives, such as a pigment, a dye, a delustering agent, a stain-proofing agent, a fluorescent brighter, a flame retardant, a stabilizer, an ultraviolet light absorbent, and a lubricant.

Next, in the polyester composition A used in the present invention, it is important that the above-described substrate polymer contains the polymer P different from the substrate polymer in an amount ranged from 0.5 to 5.0 percent by weight, preferably from 1.0 to 3.0 percent by weight. When the content is less than 0.5 percent by weight, the objects of the present invention can not be achieved, because a sufficient elongation-improving effect is not obtained. On the other hand, when the content exceeds 5 percent by weight, the elongation-improving effect passes through the peak, and the deterioration of the elongation is inversely observed. Further, the uniform elongation property of the polyester composition is easily deteriorated to develop the irregularities of fineness and dyeing, when the polyester composition is finely divided and spun. In addition, when the obtained filaments are post-processed, the irregularity of the processing tension tends to develop, thereby increasing spun yarn breakage and fuzzes.

In the present invention, only one kind of the polyester composition A may be used, or two or more kinds of the polyester compositions A may together be used. When two or more kinds of the polyester compositions A are used, the polyester compositions A may separately be melted and extruded from spinnerets to produce the filament groups A1, A2, . . . , respectively, in the melt-spinning process described later.

The preferable concrete examples of the above-described polymer P include amorphous polymers such as a polymethyl methacrylate-based polymer and a polystyrene-based polymer. The spinning tensions developed in the spinning process are concentrated on these polymers, especially the polymethyl methacrylate-based polymer having a higher glass transition temperature than that of the substrate polymer and finely dispersed in the substrate polymer. Therefore, the orientation of the substrate polyester is not only disturbed, but the crystallization of the substrate polyester is also more retarded than that of the substrate polyester in a usual state. Consequently, the filaments having a higher elongation can be obtained.

Further, the above-described polymethyl methacrylate-based polymer or polystyrene-based polymer may be the amorphous polymethyl methacrylate-based polymer or polystyrene-based polymer exhibiting an atactic or syndiotactic structure on stereoregularity, or may be the crystalline polymethyl methacrylate-based polymer or polystyrene-based polymer exhibiting an isotactic structure.

When the polymer P is homogeneously not mixed and dispersed on the preparation of the above-described polyester composition A, the condition of the later-described spinning process is generally worsened. Therefore, the polyester composition A is preferably prepared, for example, by melting the polymer P in an extruder, measuring the melted polymer P, simultaneously flowing the measured melted polymer P in the melted flow of the substrate polymer, blended by use of a static mixer or the like, and then directly supplying the blend to a spinning device as such. When the amounts of the materials to be treated are large, the materials may separately homogeneously be mixed and dispersed by use of a melting and blending device.

The above-described polyester composition A and the substrate polymer are melted and extruded from an identical spinneret or different spinnerets, respectively. Herein, the spinning temperatures of the polyester composition A and the substrate polymer may be identical or different each other, but an approximately identical temperature in the range of 280 to 300° C., especially 285 to 295° C., is usually suitable. The melt-extruding weight ratio is especially not limited, but the weight ratio of the obtained blended yarn is suitably 30:70 to 70:30, especially 40:60 to 60:40.

In the present invention, it is important to separately once cool and solidify the filament group A comprising said melt-extruded polyester composition A and the filament group B comprising the substrate polymer in conditions satisfying the below-described (1) and (2).

(1) The speed (BSb) of cooling air blown on the filament group B: 0.20 to 0.80 m/second.

(2) The speed (BSa) of cooling air blown on the filament group A: $BSa \geqq 1.1 \times BSb$.

Herein, when the speed BSb of the cooling air is less than 0.20 m/sec, the cooling effect is insufficient, and the fineness irregularity of the filament group B (including the fineness irregularity of the single filaments) is liable to be developed. On the other hand, when the speed BSb of the cooling air exceeds 0.8 m/second, the cooling effect is too large. Thereby, the crystallization of the filament group B is not only advanced to facilitate the breakage of the yarn, but the swings of the filament group are also enlarged to easily cause the fineness irregularity. Therefore, the speed BSb exceeding 0.8 m/second is undesirable. The especially preferable range of the speed BSa of the cooling air is 0.40 to 0.80 m/second.

On the other hand, when the speed BSa of the cooling air is less than 1.1 times the speed BSb of the cooling air, the elongation-increasing effect of the filament group A is insufficient, and the large elongation difference between the filament group A and the filament group B for the object of the present invention is impossible. Therefore, the small speed BSa of the cooling air is undesirable. The preferable speed ratio of the cooling air is not less than 1.2 times, and the upper limit of the speed ratio does especially not need to be limited. But, when the ratio is too large, fineness irregularity due to the swings of the filaments is liable to be developed similarly to the case of the above-described filament group B. Therefore, the speed BSa of the cooling air is desirable to be less than 0.80 m/second.

Additionally, the speed of the cooling air is the speed of the cooling air blown on each filament group at a position of 200 mm below the spinneret from which said filament group is melt-extruded, and at a position of 50 mm from the center of the traveling filaments.

When the temperature of the cooling air is too high, the cooling effect is lowered, and the fineness irregularity tends to be increased. When the temperature of the cooling air is too low, the cooling effect is not so much increased, and the cost for lowering the temperature of the cooling air is enhanced. Therefore, the temperature of the cooling air is suitable to be usually a temperature ranged from 15 to 35° C. , especially approximately room temperature.

In the present invention, it is effective for the increase in the elongation of the obtained above-described filament group A to more early cool and solidify the filament group A than the filament group B. It is therefore preferable that a distance AZa between the spinneret extrusion face for the filament group A and a cooling air-blowing start position is less than 0.8 time, especially 0.30 to 0.70 time, of a distance AZb between the spinneret extrusion face for the filament group B and a cooling air-blowing start position. Thus, similarly to the above-described effect of the cooling air speed, the cooling solidification of the filament group A comprising the polyester composition A is hastened to increase the elongation-increasing effect, and the elongation difference between the filament group A and the filament group B can be enlarged. Hence, the early cooling solidification of the filament group A is preferable.

When the distances AZa and AZb are too short, the stability of the spinning tends to be lowered. On the other hand, when the distances AZa and AZb are too long, the fineness irregularity is liable to be developed. It is therefore suitable that the distances AZa and AZb are usually ranged from 20 to 150 mm, especially from 40 to 90 mm, respectively.

In addition, it is preferable to dispose a partition plate having the same or slightly smaller diameter as or than the outer peripheral diameter of the spinneret at a place just above the cooling air-blowing start position, because the filaments are gradually cooled in the zone between said partition plate and the spinneret face to smoothly finely divide the filaments, thereby stabilizing the stability of the spinning.

Further, the cooling air blown on the filament group A and the cooling air blown on the filament group B may be blown out from different devices, respectively, so as not to interfere each other, or may be blown out from an identical device, while developing a back pressure difference to change the speed of the cooling air, disposing a partition plate, or changing areas for blowing out the cooling air.

In the present invention, it is necessary to double the above-described separately cooled filament groups A and B, subject the doubled filament groups to a blending treatment through a conventional known blending treatment device such as an air jet nozzle, and then take out the obtained blended yarn at a speed of not less than 2,500 m/min, preferably 2,500 to 6,000 m/min, especially preferably 2,500 to 5,500 m/min. Herein, when the speed for taking off the blended yarn is less than 2,500 m/min, the elongation-increasing effect of the filament group A is insufficient, and the blended yarn having a sufficiently large elongation difference can not be obtained. Thereby, the smaller taking speed is undesirable. On the other hand, when the taking speed is too large, the spinning property tends to be deteriorated. Hence, the taking speed of not more than 6,000 m/min is preferable as described above.

The total fineness of the polyester blended yarn obtained by the method of the present invention is suitably 80 to 320 dtex from the point of the touch of a fabric obtained after textured, and the single filament fineness of the filament group A and the single filament fineness of the filament group B are suitably ranged from 0.5 to 10 dtex, respectively, from the points of softness, stiffness and repulsiveness.

When the take-off speed is low, the polyester blended yarn obtained by the method of the present invention has a too large elongation in the intact state, and frequently gives a woven or knitted fabric having insufficient mechanical characteristics. Therefore, it is usually preferable to further subject the blended yarn to a drawing process (any of a separate drawing process and a direct drawing process is possible) or drawing and false-twisting processes. For example, a blended yarn taken off at a speed of about 2,500 m/min is drawn (and false-twisted) in a draw ratio of 2.0 to 2.5, or a blended yarn taken off at a speed of about 4,000 m/min is drawn (and false-twisted) in a draw ratio of 1.2 to 1.5. The drawn (and false-twisted) blended yarn is thermally set at a thermal set temperature of 150 to 230° C.

Next, the second method will be explained in detail.

The substrate polymer used in the present invention and the polymer P added to the substrate polymer are the polymers, respectively, mentioned in the above-described first method.

In the present invention, when the polymer P is, for example, the polymethyl methacrylate-based polymer and/or the polystyrene-based polymer, said polymer is preferably added to the substrate polymer in an amount of 0.3 to 5.0 percent by weight to sufficiently develop the elongation viscosity decrease and orientative crystallization control of said substrate polymer flow.

The desired amount of the polymer P to be added to the substrate polymer is generally measured with a weighing machine and then added to the substrate polymer in the form directly connected to a polymer transportation piping on the substrate polymer side or to the polymer-charging port of an extruder. The addition means includes a weighing type means and an injection type means for singly melting and extruding the addition polymer to inject the polymer into the substrate polymer side. Subsequently, the added polymer and the substrate polymer are melted, blended and extruded. The extruder includes a single screw extruder or a twin screw extruder. The twin screw extruder is preferable for improving the blending of the extruder, but even the single screw extruder can sufficiently blend the polymers. When an extruder having a changed screw groove shape, such as a Maddock type extruder, is used, the polymers are more homogeneously blended.

Hereafter, the methods will be explained in more detail with drawings. FIG. 1 is a schematic drawing for explaining one mode of the method for producing the polyester blended yarn in the present invention. In FIG. 1, the marks represent as follows. 1A, 1B extruders; 2A, 2B gear pumps; 3: a spinning pack; 4 a spinneret; 5A, 5B: two groups of traveling filament bundles; 6A, 6B: devices for bundling and oiling the filaments; GO: a distance between the spinneret face and the necking-starting point of the filament group A; GA: a distance between a bundling device and the spinneret face from which the filament group A is spun; GB is a distance between a bundling device and a spinneret face from which the filament group B is spun; 7: a device for doubling and interlacing the filaments; 8, 8': take-off rollers; 9: a winding device; 10: a device for cooling the spun filaments.

Next, the added polymer P and the substrate polymer are melted and blended with the extruder (1A in FIG. 1), measured with the gear pump (2A in FIG. 1), and then extruded from the spinneret (4 in FIG. 1) built in the spinning pack (3 in FIG. 1) as the filament group A. On the other hand, the substrate polymer is melted with such the extruder as represented by 1B of FIG. 1, measured with the gear pump (2B in FIG. 1) and then extruded from the spinneret (4 in FIG. 1) as the filament group B. Subsequently, the filament groups A, B are cooled with the cooling device 10, and then bundled and oiled with the bundling devices 6A, 6B. The bundled and oiled filament groups A and B are blended with the interlacing device 7 and then wound up with the winding device 9 through the take-off rollers 8, 8'.

In this spinning process, a spinning tension applied to the polymer flow of the filament group A (5A in FIG. 1) containing the polymer P added thereto is apparently higher than that of the polymer flow of the filament group B (5B in FIG. 1) comprising the substrate polymer. The phenomenon is estimated to be caused by the localization of the spinning tension in the polymer flow and the resulting apparent increase of the spinning tension, because the added polymer is incompatible with the substrate polymer. Such the non-uniform tensions induce the breakage of the yarn.

The inventors of the present invention have ascertained that, when the distance GA between the bundling device and the spinneret face for spinning the filament group A is kept within a specific range, the development of the non-uniform spinning tensions in the polymer flow of the filament group A is reduced to largely decrease the breakage of the yarn.

Namely, in the present invention, it is important to arrange the bundling device for bundling the filament group A in a range represented by the following expression.

$$GO<GA\leqq 200 \text{ (cm)}$$

Therein, GO is a distance between the face of the spinneret and the necking-starting point of the filament group A, and GA is a distance between the bundling device and the face of the spinneret for spinning the filament group A therefrom.

When the above-described distance GA is not more than GO, the breakage of the spun yarn due to the mutual cohesion of the polymer single filaments or due to the damages of the single filaments is rapidly increased to make stable spinning and take-off operations impossible.

On the other hand, when the above-described distance GA exceeds 200 cm, the swings of the traveling filaments are highly increased to frequently cause the breakage of the spun yarn. Further, GA of not more than 150 cm is preferable, because the breakage of the spun yarn is more remarkably decreased.

The necking-starting point in the present invention is a point where the change of the speed is largest, when laser beams are sequentially applied to the traveling filament group at intervals of 5 cm from a position of 5 cm just below the spinneret face by use of a laser doppler filament speed meter, measuring the reflected light, and then converting the measured reflected light into the speeds.

Additionally, in the present invention, the necking phenomenon of the filament group A is observed at a point whose distance from the spinneret is smaller than that of the filament group B. Thereby, when the filament group B and the filament group A are bundled at an identical position, the filament group B may be brought into contact with the bundling device in a state that the structure of the filament group B is sufficiently not formed. It is hence preferable that the distance GB between the bundling device and the spinneret for spinning the filament group B is set to be larger than the above-described distance GA.

In the present invention, since the exhibition of the more remarkable effect, the decrease in the swings of the filaments on the spinning, and the improvement in the stability of the process can be achieved, when the fineness range of the filament group A obtained after spun is ranged from 50 to 300 dtex, it is preferable to spin the filament group A in said temperature range in the present invention.

In the present invention, it is preferable to wind up the blended yarn at a speed of not less than 2,000 m/min to more largely develop the elongation difference between said filament groups. The elongation difference between the two filament groups constituting the blended yarn produced thus is not less than 80%, and a woven fabric formed from the drawn and false-twisted yarns of the blended yarns exhibits rich bulkiness and excellent touch. When said elongation difference is too large, the breakage of the yarn due to the fluctuation of tension in the false-twisting process tends to be increased, and when the elongation difference is especially not less than 250%, the swings of the filament group on the high elongation side are enlarged, and the filament group tends to slip out from the heater, disk or cooling plate of a false-twisting device. Thereby, in order to satisfy both the dignity of the fabric and the post processing productivity such as false-twisting processability, it is preferable to control the elongation difference of the blended yarn between the filament groups in a range of not less than 80% and less that 250%.

Furthermore, the third method will be explained in detail.

In the present invention, the substrate polymer is the polyester mentioned in the above-described first process, but it is necessary that the polymer to be added to the polyester is the polymethyl methacrylate-based polymer and/or the polystyrene-based polymer. Therein, the melt viscosity (MVPM) of the polymethyl methacrylate-based polymer must be not less than 0.6 per the melt viscosity (MVPE) of the polyester which is the substrate polymer. When the melt viscosity (MVPM) is less than the value, the elongation difference between the filament group B comprising the substrate polymer and the filament group A containing the above-described polymer becomes about 40 to 70%, and the touch of a fabric using the obtained blended yarns does not reach a desired level. When the MVPM is less than 0.6 MVPE, a sufficient elongation difference will not be developed, if the amount of the added polymethyl methacrylate-based polymer is considerably increased. The breakage of the yarn on the spinning process or the breakage of the yarn on the drawing and false-twisting processes, a process failure such as the winding of a single filament on a roller, or the production of a textured yarn having many defects such as fuzzes or loops will be caused with the excessive addition of the polymer. Thus, the inventors of the present invention have ascertained that the blended yarn for developing a desired fabric dignity is not obtained, when the ratio of the melt viscosity (MVPM) of the added polymethyl methacrylate-based polymer to the melt viscosity (MVPE) of the polyester used as the substrate is less than 0.6.

Similarly on the polystyrene-based polymer, it has been found that it is an essential condition to control the ratio of the melt viscosity (MVPS) of the polystyrene-based polymer to the melt viscosity (MVPE) of the polyester to not less than 1.5.

In addition, when the mixture of the polymethyl methacrylate-based polymer with the polystyrene-based polymer is used, the elongation difference between the filament group A and the filament group B comprising the substrate polymer is more developed, and a fabric having a better touch is obtained. Also when the polymethyl methacrylate-based polymer or the polystyrene-based polymer is singly added, the sufficient effect is developed as described in the preceding paragraph. Therefore, the condition of the present invention is not limited to the mixing addition.

Further, in experiments in which the amount of the added polymethyl methacrylate-based polymer or polystyrene-based polymer is changed, the amount of less than 0.3 percent by weight does not give a sufficient elongation difference. The amount of more than 5 percent by weight causes an excessive orientation-inhibiting phenomenon, the non-uniform fine division of the substrate polymer due to the added component, the development of a liquid-like breaking phenomenon accompanied by a local stress concentration, the denier irregularity of the filaments, the breakage of the yarn in the false-twisting process, the development of fuzzes, and further the development of uneven dyeing. Therefore, the amount of the polymer added thus is suitably ranged from 0.3 to 5.0 percent by weight, preferably 1.0 to 3.0 percent by weight.

The addition of the polymethyl methacrylate-based polymer or the polystyrene-based polymer to the substrate polymer can be carried out by the same method as the below-mentioned second method.

Figure 2:
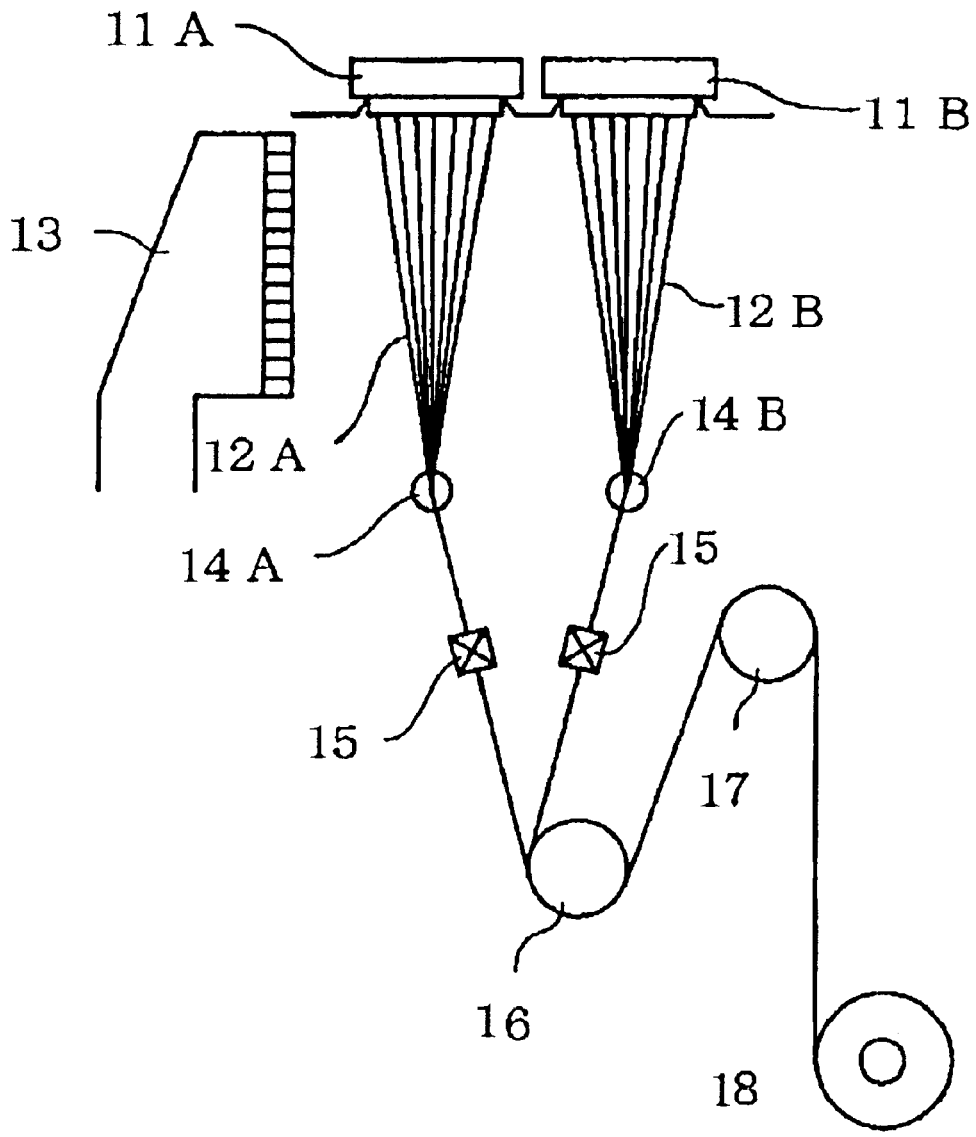
FIG. 2 is a schematic diagram exemplifying a process for carrying out the above-described third method.

Hereafter, the method of the present invention will be explained in more detail with the drawing. FIG. 2 is a schematic drawing for explaining one mode of the method for producing the polyester blended yarn in the present invention. In FIG. 2, the marks show as follows. 11A and 11B: spinnerets, 12A and 12B: two groups of traveling filament bundles, 13: a spinning-cooling device, 14A and 14B: oiling devices, 15: an interlacing device, 16 and 17: take-off rollers, and 18: a wind-up device.

A polyester composition prepared by adding and mixing the polymethyl methacrylate-based polymer and/or the polystyrene-based polymer to the substrate polymer is melted and extruded from the spinneret 11A as the filament group A (12A in FIG. 2). On the other hand, the substrate polymer is melted and extruded from the spinneret 11B as the filament group B (12B in FIG. 2). The filament group A and the filament group B are cooled and solidified with cooling air blown out from the spinning-cooling device 13, then oiled with the oiling devices 14A and 14B, interlaced with the interlacing devices 15, taken off on the take-off rollers 16 and 17, and then doubled and wound up with the wind-up device 18. The filament group 12A and the filament group 12B may be interlaced with the interlacing device 15 and then further interlaced with an interlacing device set between the take-off rollers 16 and 17 or between the take-off roller 17 and the wind-up device 18. The spinning take-off speed is preferably set to a range of 2,500 to 6,000 m/min. When the take-off speed is less than 2,500 m/min, the orientative crystallization-inhibiting effect by the addition of the polymethyl methacrylate-based polymer and/or the polystyrene-based polymer is small, and, when the take-off speed exceeds 6,500 m/min, the control of the spinning operation is difficult. The polyester blended yarn wound up with the installation depicted in said FIG. 2 and comprising the filament group A (12A in FIG. 2) and the filament group B (12B in FIG. 2) is further false-twisted to give the bulky processed yarn.

In the present invention, the single filament fineness and/or total fineness of the filament group A may be the same as or different from the single filament fineness and/or total fineness of the filament group B. Further, the cross-sectional shape of the filament group A may be the same as or different from the cross-sectional shape of the filament group B. When the total fineness of the blended yarn is too large, roughness rather than swelling is developed in a fabric, and when the fineness is small, a touch of hard impression is given. Thereby, when used as a false-twisted yarn, the fineness of the yarn is preferably ranged from 75 dtex to 400 dtex, after textured, especially preferably 120 dtex to 300 dtex, after false-twisted. The single filament fineness of the filament group A and the single filament fineness of the filament group B are preferably 1 to 15 dtex, respectively.

The inventors of the present invention have zealously analyzed the relations of the elongation difference between the filament groups constituting the polyester blended yarn produced thus to the touch and dyed state of a fabric using the textured yarns prepared by drawing and false-twisting said blended yarns, and have consequently experimentally confirmed that the false-twisted yarn having excellent bulkiness and repulsiveness and easily developing a desired fabric quality is obtained, when the elongation difference between the filament groups constituting the blended yarn is not less than 80%. However, when the elongation difference was too large, it has been recognized that the frequency of yarn breakage due to the fluctuation of the tension in the false-twisting process tends to increase. When the elongation difference is not less than 250%, the filament group on the high elongation side is largely swung to easily slip out from the heater, disk or cooling plate of a false-twisting device. Thereby, the elongation difference between the filament groups of the blended yarn, satisfying both the dignity of the fabric and the post-texturing productivity such as the false-twisting property is preferably not less than 80% and less than 250%.

Hereafter, the invention will more concretely be explained in Examples.

First, the first method will be explained. Therein, the elongation, strength, deep coloring property, unevenness in dyeing, touch, and process conditions described in Examples and Comparative examples were measured by the following methods.

(1) Elongation, Strength

Breaking elongations and breaking strengths were determined from a load-elongation curve obtained using a Tensilon tensile tester. The elongation (ELb) of a yarn produced from only the substrate polymer was used as a criterion, and the filament group A and the filament group B melted and extruded from an identical spinneret or from different spinnerets were separately sampled, and the elongation (ELa) and the elongation (ELb) were determined from the load-elongation curves, respectively. The elongation difference is shown as ΔEL.

(2) Deep Coloring Property, Uneven Dyeing

A stockinet sample comprising the blended yarns was placed in a dyeing machine in a dye:sample bath ratio of 1:50, and 1% of Sumikaron and 10 g of Monogen were used as dyes. The sample was dyed in conditions comprising heating the dyeing bath from ordinary temperature to 80° C. for 20 minutes and from 80° C. to 130° C. for 30 minutes, holding the state for 20 minutes, and then returning the dyeing bath to the ordinary temperature. The obtained sample was visually judged by a 1 to 5 point evaluation method. The point of the deep coloring property was progressively enhanced as the depth of the color and the height of the deep dyeability were increased. Single filaments or a yarn prepared by blending the single filaments as a base were compared. A sample used as the base was defined as 1, and a sample having the most concentrated and deepest color was defined as 5. A sample having only the concentrated color was defined as 4 to 3, and a sample having a slightly more concentrated color than that of the base sample was defined as 3 to 2. The uneven dyeing was also visually judged similarly to the deep coloring property. The unevenness in the dyeing of the sample having a good blended state and developing a clear grandrelle yarn type color tone was defined as 3, and that of a sample never developing the grandrelle yarn type color tone was defined as 1. The state of a sample deeply dyed but exhibiting a color tone continuously developing the grandrelle yarn type was judged to be a good dyed state.

(3) Touch

A stockinet sample comprising the above-described dyed blended yarns was compared with a stockinet sample comprising yarns otherwise obtained from only the substrate polymer and blended yarns obtained from the filament groups A and B to which cooling air was applied at an identical speed, respectively, and the touch (softness, repulsiveness, swelling) of the sample was judged as 4 (extremely good), 3 (good), 2 (somewhat good), and 1 (defective) in this order from the good sample.

(4) Process Condition

The number of spun yarn breakages per day, spindle was measured. The process condition was shown using the average value of the measured numbers, when the measurements were continued for one week, and evaluated according to the following standards.

4: less than 0.5 time.

3: not less than 0.5 time and less than 1.0 time.

2: not less than 1.0 time and less than 2.0 times.

1: not less than 2.0 times.

respectively. For example, the upper and lower stages of the cooling air speed are BSa and BSb, respectively. The upper and lower stages of the cooling air-blowing start position are AZa and AZb, respectively, and the upper and lower stages of the elongation are ELa and ELb, respectively.

TABLE 1

| | # 1 | Content of PMMA wt % | Cooling air speed m/sec | Cooling air-blowing start position mm | Take-off speed m/min | # 2 % | # 3 % | Strength CN/dtex | # 4 | # 5 | Touch | # 6 |
|---|---|---|---|---|---|---|---|---|---|---|---|---|
| Example 1 | A | 2.0 | 0.46 | 80 | 4500 | 81 | 36 | 3.6 | 4 | 3 | 3 | 4 |
| | B | 0 | 0.40 | 90 | | 45 | | 4.0 | | | | |
| Example 2 | A | 2.0 | 0.60 | 80 | 4500 | 92 | 47 | 3.0 | 5 | 3 | 4 | 3 |
| | B | 0 | 0.40 | 90 | | 45 | | 4.0 | | | | |
| Example 3 | A | 2.0 | 0.70 | 80 | 4500 | 99 | 52 | 2.8 | 5 | 3 | 4 | 2 |
| | B | 0 | 0.40 | 90 | | 45 | | 4.0 | | | | |
| Example 4 | A | 1.5 | 0.70 | 45 | 4500 | 88 | 43 | 3.1 | 5 | 3 | 4 | 3 |
| | B | 0 | 0.40 | 90 | | 45 | | 4.0 | | | | |
| Example 5 | A | 3.0 | 0.60 | 80 | 4500 | 105 | 60 | 2.6 | 5 | 3 | 4 | 2 |
| | B | 0 | 0.40 | 90 | | 45 | | 4.0 | | | | |
| Comparative example 1 | A | 0 | 0.40 | 90 | 4500 | 45 | 0 | 4.0 | 1 | 1 | 1 | 4 |
| | B | 0 | 0.40 | 90 | | 45 | | 4.0 | | | | |
| Comparative example 2 | A | 0 | 0.60 | 90 | 4500 | 41 | −4 | 4.1 | 1 | 1 | 1 | 4 |
| | B | 0 | 0.40 | 90 | | 45 | | 4.0 | | | | |
| Comparative example 3 | A | 2.0 | 0.40 | 90 | 4500 | 67 | 22 | 3.4 | 3 | 2 | 2 | 4 |
| | B | 0 | 0.40 | 90 | | 45 | | 4.0 | | | | |
| Comparative example 4 | A | 0.3 | 0.60 | 80 | 4500 | 48 | 3 | 4.0 | 1 | 1 | 1 to 2 | 4 |
| | B | 0 | 0.40 | 90 | | 45 | | 4.0 | | | | |
| Comparative example 5 | A | 2.0 | 0.40 | 85 | 4500 | 70 | 25 | 3.3 | 3 | 3 | 2 to 3 | 3 |
| | B | 0 | 0.43 | 90 | | 45 | | 4.0 | | | | |

1: Filament group
2: Elongation
3: Elongation difference
4: Deep coloring property
5: Uneven dyeing
6: Process condition

EXAMPLES 1 TO 5, COMPARATIVE EXAMPLES 1 TO 5

Polyethylene terephthalate having an intrinsic viscosity of 0.64 and a titanium oxide content of 0.3 percent by weight was used as a substrate polymer. A polyester composition prepared by adding the polymethyl methacrylate-based polymer described in Table 1 to said substrate polymer, and the substrate polymer were melted and extruded as filament groups A and B, respectively, from separated spinnerets (any of both had a nozzle diameter of 0.2 mm, a land length of 0.8 mm, and 36 nozzles) set in an identical spinning pack at a melting temperature of 295° C. Said extruded filament groups were separately cooled and solidified at the cooling air-blowing positions and at the cooling temperatures described in Table 1, and both the solidified filament groups were then doubled and blended. The blended yarn was taken off at the speed described in Table 1, and then wound up to give the blended yarn of 56 dtex/56 dtex (A/B). The evaluation results are shown in Table 1.

In the Table 1, the filament group A and the filament group B are shown at the upper and lower stages of each column, Examples 1 to 3 are the results of cases. In each case, the amount of the added polymethyl methacrylate-based polymer is controlled to a constant value of 2 percent by weight, while the speed of the cooling air is changed. It is estimated that the elongation difference between the filament groups A and B and the un-oriented portions of the filament group A are increased as the speed of the cooling air is enhanced, and it found that the knitted fabric dyed in a high concentration and exhibiting a rich touch is obtained. Example 4 is a case that the amount of said polymer is slightly smaller than that of Example 3, while the speed of the cooling air is enhanced to the same speed as that of Example 3, is good in both the touch the dyed result, and is further good in the process condition just only by the reduced amount. Further, Example 5 shows that the elongation difference, the unevenness in dyeing, the deed dyeability, and the touch are good as the result of the increase in the amount of said polymer to 3 percent by weight, but the process condition tends to be somewhat deteriorated, although not deteriorated to a level at which the production is impossible. On the other hand, Comparative examples 1 to 2 are an example (Comparative example 1) wherein said polymer is not added and the cooling air is blown on the filament groups A and B at an identical speed, and an example (Comparative example 2) wherein the speed of the cooling air on the filament group A is identical with that of Example 2. It is found that in any of Comparative examples 1 and 2, the elongation of the filament group A is not larger than the elongation of the filament group B, while the elongation of the filament group A is slightly lowered in Comparative example 2. Comparative examples 3, 5 are an example (Comparative example 3) wherein the amount of said polymer is identical with those in Examples 1 to 3 and the speed of the cooling air blown on the filament group A is identical with that of the cooling air blown on the filament group B, and an example (Comparative example 5) wherein the speed of the cooling air is somewhat enhanced, and it is found that the example is slightly interior on the points of the touch and the deep dyeability, while the elongation difference is obtained in some extent. Further, Comparative example 4 is an example wherein said polymer is reduced to a smaller amount than the range of the present invention, and it is found that the example is slightly inferior on the points of the touch and the deep dyeability, because a sufficient elongation difference is not obtained.

EXAMPLE 6 TO 8, COMPARATIVE EXAMPLES 6 TO 8

Examples were carried out similarly to Example 1 except that the cooling air-blowing start positions blown on the filament groups A, B were changed as described in Table 2, and the results are shown in Table 2.

TABLE 2

| | # 1 | Amount of PMMA wt % | Cooling air-speed m/sec | Cooling air-blowing start position mm | Taking-off speed m/min | # 2 % | # 3 % | Strength cN/dtex | # 4 | # 5 | Touch | # 6 |
|---|---|---|---|---|---|---|---|---|---|---|---|---|
| Example 6 | A | 2.0 | 0.46 | 70 | 4500 | 85 | 40 | 3.2 | 5 | 3 | 3 | 3 |
| | B | 0 | 0.40 | 90 | | 45 | | 4.0 | | | | |
| Example 7 | A | 2.0 | 0.46 | 45 | 4500 | 92 | 47 | 3.1 | 5 | 3 | 4 | 2 |
| | B | 0 | 0.40 | 90 | | 45 | | 4.0 | | | | |
| Example 8 | A | 2.0 | 0.46 | 45 | 4500 | 92 | 50 | 3.1 | 5 | 3 | 4 | 2 |
| | B | 0 | 0.40 | 45 | | 42 | | 4.1 | | | | |
| Comparative example 6 | A | 0 | 0.40 | 70 | 4500 | 43 | −2 | 4.1 | 1 | 1 | 1 | 4 |
| | B | 0 | 0.40 | 90 | | 45 | | 4.0 | | | | |
| Comparative example 7 | A | 0 | 0.60 | 45 | 4500 | 40 | −2 | 4.1 | 1 | 1 | 1 | 4 |
| | B | 0 | 0.40 | 90 | | 42 | | 4.0 | | | | |
| Comparative example 8 | A | 2.0 | 0.46 | 150 | 4500 | 76 | 31 | 3.4 | 3 | 2 | 2 | 4 |
| | B | 0 | 0.40 | 90 | | 45 | | 4.0 | | | | |

1: Filament group
2: Elongation
3: Elongation difference
4: Deep coloring property
5: Uneven dyeing
6: Process condition Subsequently, the second method will more concretely be explained using Examples. Filament travel states, spun yarn breakage, necking-starting points, and elongation differences described in Examples and Comparative examples were measured by the following methods.

(5) Filament Travel State

The presence or absence of travel troubles, such as the swings of the filaments and the mutual cohesion of the single filaments, was observed from the front of the spinning cooling device 10.

(6) Necking-Starting Point

A laser doppler filament speed meter manufactured by Nippon Kanomax Inc. was used to sequentially apply laser beams to a traveling filament group at intervals of 5 cm from a position of 5 cm just below the spinneret face, and the reflected beams were measured. The measurement values were converted into the speeds. A position where the speed is most largely changed and is near to the final filament travel speed (3,400 m/min in Examples) was determined as the necking-starting point.

(7) Spun Yarn Breakage

The spinning device depicted in FIG. 1 was continuously operated for one week, while the spun yarn breakage numbers per day per spindle were recorded. The average spun yarn breakage number was shown. When the average spun yarn breakage number was less than 1, the spinning stability was defined to be good.

(8) Elongation Difference

The breaking elongation of each filament group was measured from the load-elongation curve, of the obtained blended yarn with a Tensilon tensile tester. The absolute value of the elongation difference between the filament group A comprising the polyester composition A containing the polymer P and the filament group B comprising only the substrate polymer was used as the elongation difference. Since said filament group A and said filament group B are interlaced with each other in the blended yarn of the present invention, it is preferable to separately sample the filament groups A, B and then separately measure the elongations of the filament groups A, B, but the breaking elongations of said filament groups A, B can be distinguished from the shape of an obtained load-elongation curve, even when measured in the interlaced blended yarn state. Hence, said filament groups A, B were directly elongated and measured in the blended yarn state.

EXAMPLES 9 TO 11, COMPARATIVE EXAMPLES 9 TO 10

Polyethylene terephthalate having an intrinsic viscosity of 0.64 and containing titanium oxide in an amount of 0.3 percent by weight was prepared as a substrate polymer. Said substrate polymer was mixed with 1.0 percent by weight of polymethyl methacrylate polymer having a melt viscosity of 1,600 poise and 1.0 percent by weight of polystyrene polymer having a melt viscosity of 3,500 poise. The mixture was melted and blended with an extruder depicted as 1A in FIG. 1, measured with a gear pump (2A in FIG. 1), and then spun from a spinneret (4 in FIG.) built in a spinning pack (3 in FIG. 1) and having 48 nozzles each having a nozzle diameter of 0.23 mm and a land length of 0.6 mm. The spun filaments were bundled and simultaneously oiled at a position 6A in FIG. 1 to form the filament group A (5A in FIG. 1). On the other hand, polyethylene terephthalate was melted and kneaded with an extruder depicted as 1B in FIG. 1, measured with a gear pump (2B in FIG. 1), and then spun from a spinneret (4 in FIG. 1) built in the spinning pack (3 in FIG. 1) and having 48 nozzles each having a nozzle diameter of 0.23 mm and a land length of 0.6 mm. The spun filaments were bundled and simultaneously oiled at a position 6B in FIG. 1 to form the filament group B (5B in FIG. 1). Said filament group B and said filament group A were doubled and interlaced with each other with an interlacing device depicted as 7 in FIG. 1 and then wound up at a speed of 3,400 m/min to obtain the blended yarn of 300 dtex. The spinning device depicted in FIG. 1 was continuously operated in the above-described conditions for one week, and the traveling filament yarn was observed. The observation results, the total spun yarn breakage numbers and the elongation differences are shown in Table 3.

TABLE 3

| | GA (cm) | Filament travel state | G0 (cm) | Spun yarn breakage (number/spindle/day) | Elongation difference (%) |
|---|---|---|---|---|---|
| Example 9 | 200 | # 1 | 40 | 0.60 | 157 |
| Example 10 | 130 | # 1 | 40 | 0.25 | 165 |
| Example 11 | 50 | # 1 | 40 | 0.20 | 168 |
| Comparative example 9 | 220 | # 2 | 40 | 2.50 | 147 |
| Comparative example 10 | 40 | # 3 | 40 | 5.50 | 138 |

1: The filaments stably traveled without being swung.
2: The traveling filament groups were largely swung and frequently wound around a take-off roller.
3: The yarn breakage resulted from the mutual cohesion of the single filaments.

The travel state of the filament group A was substantially free from the swings of the filaments and was stable in any of the conditions of Example 9 in which the distance GA between the bundling device and the spinneret face for spinning the filament group A therefrom was 200 cm, Example 10 in which the distance GA was 130 cm, and Example 11 in which the distance GA was 50 cm. The occurrence of the spun yarn breakage was also little, and a stable continuous spinning operation was possible for one week. In any case, the distance GO between the spinneret face and the necking-starting point of the filament group A was 40 cm which was a shorter distance than the above-described distance GA between the spinneret face and the bundling device. In any case, the elongation distance of the obtained blended yarn between the filament groups was not less than 80%, and had physical properties useful as a blended yarn for a woven fabric.

In Comparative example 9 in which the distance between the bundling device and the spinneret face for spinning the filament group A therefrom was set to 220 cm, large filament swings were recognized in the filament group A, and the filaments were frequently wound around the take-off roller. The total spun yarn breakage number was not less than 2, and the decrease in the operation rate and the by-production of waste yarns in a large amount were brought about.

In Comparative example 10 in which the above-described distance GA was set to the same 40 cm as the distance GO between the spinneret face and the necking-starting point of the filament group A, the mutual cohesion of the single filaments in the filament group A occurred frequently. Therefore, the spinning and winding operations became difficult, and the continuous operation was impossible.

Further, the third method will more concretely be explained using Examples. The melt viscosities, elongation differences, touch, spinning conditions, and processing conditions of Examples and Comparative examples were measured by the following methods.

(9) Melt Viscosities (MVPM, MVPS, MVPE)

Each of the melt viscosities of the polymethyl methacrylate, the polystyrene and the polyethylene terephthalate used in the present invention was determined by detecting an extrusion pressure with a Shimadzu flow tester manufactured by Shimadzu Seisakusho Co. and having an orifice having a nozzle diameter of 0.5 mm and a land length of 1 mm at a cylinder temperature of 295° C. under a load of 20 Kg, and then extrapolating the detected extrusion pressure into a viscosity expression. The measured melt viscosity MVPE of the polyethylene terephthalate as the substrate polymer was 1,400 poise. The ratio of the measured melt viscosity of the polymethyl methacrylate or the polystyrene to the measured melt viscosity MVPE was calculated.

(10) Elongation Difference

The measurement of the elongation difference was performed by the same method as that in the above-described (8).

(11) Touch

The obtained blended yarns were drawn and false-twisted in conditions shown in the other paragraphs to obtain the textured yarns. The textured yarns were woven to form the woven fabrics for evaluating the touch, respectively. On the other hand, the polyester textured yarns each having the characteristics shown in Table 2 and having the filament number of 96 were woven to form a standard woven fabric used for comparing the touch. A woven fabric having softer touch and richer bulkiness than those of the standard woven fabric, a woven fabric having somewhat softer touch, a woven fabric having the same soft touch, and a woven fabric having harder touch were shown as 4, 3, 2, and 1, respectively. Further, the grandrelle yarn type as the representative characteristic of color tone was used as an evaluation item and visually judged as follows. A woven fabric having a color concentration difference and having a clear grandrelle, a woven fabric having a distinguishable grandrelle, a woven fabric having a scarcely distinguishable grandrelle were shown as 4, 3, and 1, respectively. Lower one among the touch and the grandrelle yarn type evaluation was adopted as the final touch evaluation point.

(12) Spinning Condition

The spun yarn breakage number per day per spindle in the spinning device depicted in FIG. 1 was recorded. The spinning condition was shown using the average value of the yarn breakage numbers, when the spinning device was continuously operated for one week, and evaluated according to the following standards.

4: less than 0.3 time.

3: not less than 0.3 time and less than 0.7 time.

2: not less than 0.7 time and less than 2.0 times.

1: not less than 2.0 times.

(13) Processing Condition

When drawing and false-twisting treatments were performed, the yarn breakage number per day on one drawing and false-twisting machine was recorded. The processing condition was shown using the average value of the yarn breakage numbers, when the drawing and false-twisting machine was continuously operated for one week, and evaluated according to the following standards. The yarn breakage numbers did not contain the number of yarn breakages happened before or after a piecing treatment and the number of yarn breakages caused by an automatic switching treatment, and were shown only with the number of yarn breakages caused by the raw yarn.

4: less than 15 times.

3: not less than 15 times and less than 23 times.

2: not less than 23 times and less than 30 times.

1: not less than 30 times.

EXAMPLES 12 TO 20, COMPARATIVE EXAMPLES 11 TO 17

Polyethylene terephthalate having an intrinsic viscosity of 0.64 and containing 0.3 percent by weight of titanium oxide was used as a substrate polymer. Said substrate polymer was singly or mixed with polymethyl methacrylate and/or polystyrene (the polymethyl methacrylate and the polystyrene were shown with omission marks of PMMA and PS, respectively, in the column for the additives of the filament group A in Table 4) in amounts shown in Table 4, melted, kneaded, and then spun from a spinneret (11A in FIG. 2) having 48 nozzles each having nozzle diameter of 0.23 mm and a land length of 0.6 mm. The obtained filaments were cooled, oiled and then interlaced to form the filament group A. On the other hand, the polyethylene terephthalate used as the above-described substrate polymer was spun from a spinneret (11B in FIG. 2) disposed in the same spinning pack and having 48 nozzles each having a nozzle diameter of 0.23 mm and a land length of 0.6 mm. The obtained filaments were cooled, oiled, and then interlaced to form the filament group B. Said filament group B and said filament group A were doubled with each other and then wound up at a speed of 3,200 m/min to obtain the blended yarn of 300 dtex.

The obtained blended yarn was drawn and false-twisted with 216 units spinning machine [HTS-15V] manufactured by Teijin Seiki Limited at a false-twisting speed of 800 m/min in a ratio of 1.60 at a front heater temperature of 550° C. at a back heater temperature of 350° C. in a urethane disk having thickness of 9 mm to obtain the textured yarn having characteristics shown in Table 5. The evaluation results are collectively shown in Tables 4 and 5.

TABLE 4

| | Additive ratio of filament group A | | Melt viscosity (poise) of additive | | Amount of additive | | | | |
|---|---|---|---|---|---|---|---|---|---|
| | PMMA | PS | PMMA | PS | (wt %) | # 1 | Touch | # 2 | # 3 |
| Example 12 | 1.0 | 0 | 1200 | — | 1 | 82 | 3 | 4 | 4 |
| Example 13 | 1.0 | 0 | 1600 | — | 1 | 97 | 3 | 4 | 4 |
| Example 14 | 1.0 | 0 | 1600 | — | 2 | 140 | 4 | 4 | 4 |
| Example 15 | 0 | 1.0 | — | 2500 | 1 | 83 | 3 | 4 | 4 |
| Example 16 | 0 | 1.0 | — | 2500 | 2 | 120 | 3 | 4 | 4 |
| Example 17 | 0 | 1.0 | — | 5000 | 1 | 120 | 3 | 4 | 4 |
| Example 18 | 0 | 1.0 | — | 5000 | 2 | 160 | 4 | 3 | 3 |
| Example 19 | 0.68 | 0.32 | 1600 | 5000 | 2 | 153 | 4 | 4 | 4 |
| Example 20 | 0.4 | 0.6 | 1200 | 2500 | 2 | 132 | 4 | 4 | 4 |
| Comparative example 11 | 1.0 | 0 | 700 | — | 3 | 65 | 1 | 4 | 4 |
| Comparative example 12 | 1.0 | 0 | 700 | — | 5.5 | 89 | 3 | 1 | 1 |
| Comparative example 13 | 1.0 | 0 | 1200 | — | 0.2 | 26 | 1 | 4 | 4 |
| Comparative example 14 | 0 | 1.0 | — | 2000 | 2 | 36 | 1 | 4 | 4 |
| Comparative example 15 | 0 | 1.0 | — | 2000 | 5 | 78 | 1 | 2 | 2 |
| Comparative example 16 | 0 | 1.0 | — | 5000 | 0.2 | 56 | 1 | 4 | 4 |
| Comparative example 17 | 0 | 1.0 | — | 5000 | 5.2 | 250 | 4 | 1 | 1 |

1: Elongation difference.
2: Spinning condition.
3: Texturing condition

TABLE 5

| | Fineness (dtex) | Strength (cN/dtex) | Elongation (%) |
|---|---|---|---|
| Textured yarn for standard woven fabric | 190 | 1.85 | 17 |
| Textured yarn of Example 12 | 190 | 1.68 | 18 |
| Textured yarn of Example 13 | 190 | 1.68 | 22 |
| Textured yarn of Example 14 | 190 | 1.15 | 27 |
| Textured yarn of | 190 | 1.68 | 18 |

TABLE 5-continued

| | Fineness (dtex) | Strength (cN/dtex) | Elongation (%) |
|---|---|---|---|
| Example 15 | | | |
| Textured yarn of Example 16 | 190 | 1.24 | 26 |
| Textured yarn of Example 17 | 190 | 1.24 | 26 |
| Textured yarn of Example 18 | 190 | 1.15 | 28 |
| Textured yarn of Example 19 | 190 | 1.15 | 28 |
| Textured yarn of Example 20 | 190 | 1.24 | 27 |
| Textured yarn of Comparative example 11 | 190 | 1.94 | 17 |
| Textured yarn of Comparative example 12 | 190 | 1.77 | 19 |
| Textured yarn of Comparative example 13 | 190 | 2.65 | 15 |
| Textured yarn of Comparative example 14 | 190 | 2.56 | 16 |
| Textured yarn of Comparative example 15 | 190 | 1.85 | 25 |
| Textured yarn of Comparative example 16 | 190 | 2.38 | 18 |
| Textured yarn of Comparative example 17 | 190 | 1.06 | 29 |

Examples 12 to 14 are examples in whose each only the polymethyl methacrylate was added to the polyethylene terephthalate of substrate polymer, followed by melt-spinning the mixture to form said filament group A. In Example 12, the polymethyl methacrylate having a melt viscosity (MVPM) of 1,200 poise and a MVPM/MVPE ratio of 0.857 was added in an amount of 1%. The obtained blended yarn had an elongation difference of 82%, and a soft woven fabric having a distinguishable grandrelle was obtained. Further, the spun yarn breakage was less than 0.3 time, and the textured yarn breakage was less than 15 times. In Examples 13, 14, polymethyl methacrylate having a melt viscosity (MVPM) of 1,600 poise and a MVPM/MVPE ratio of 1.14 was added in amounts of 1% and 2%, respectively. In any of Examples 13, 14, the elongation difference of the obtained blended yarn was not less than 80%, and the touch of the woven fabric reached an acceptance level. Especially in Example 14, an elongation difference of 140% was developed, and the touch of the woven fabric was extremely good. In any Example, the spinning condition and the texturing condition were good.

Examples 15 to 18 are examples in whose each only the polystyrene is added to the polyethylene terephthalate of substrate polymer, followed by melt-spinning the mixture to form said filament group A. In Examples 15, 16, the polystyrene having a melt viscosity (MVPS) of 2,500 poise and an MVPS/MVPE ratio of 1.79 was used, and the amount of the added polystyrene was changed. In Examples 17, 18, the polystyrene having a melt viscosity MVPS of 5,000 poise and an MVPS/MVPE ratio of 3.57 was used, and the amount of the added polystyrene was changed. In any Example, the elongation difference of the obtained blended yarn was not less than 80%, and the touch of the woven fabric reached an acceptance level. Especially in Example 18, an elongation difference of 160% was developed, and the touch of the woven fabric was remarkably good. Further, in any Example, the spinning condition and the texturing condition were good.

In Example 19, 20, the polymethyl methacrylate and the polystyrene were preliminarily mixed, and then added to the polyethylene terephthalate of substrate polymer, followed by melt-spinning the mixture to form said filament group A. Judgement results comprising better touch, spinning condition and texturing condition than those of cases in which the polymethyl methacrylate and the polystyrene were singly added, respectively, were obtained.

In Comparative examples 11, 12, the polymethyl methacrylate having a melt viscosity MVPM of 700 poise and an MVPM/MVPE ratio of 0.5 was used. In Comparative example 11 in which the polymethyl methacrylate was added in an amount of 3 percent by weight, the elongation difference of the obtained blended yarn was 65%, and the touch of the obtained woven fabric was a level worthless for the commercialization of the woven fabric. In Comparative example 12 in which the amount of the added polymethyl methacrylate was increased to 5.5 percent by weight, the elongation difference of the obtained blended yarn reached 89%, but the spun yarn breakage and the textured yarn breakage frequently happened, and the productivity was lowered.

Comparative example 13 is an example in which the polymethyl methacrylate used in Example 12 was used in a reduced amount. Since the amount of the added polymethyl methacrylate was small, the developed elongation difference of the obtained blended yarn was only 26%, and the touch of the obtained woven fabric was a level worthless for the commercialization of the woven fabric.

Comparative examples 14, 15 are examples in which the polystyrene having a melt viscosity MVPS of 2,000 poise and an MVPS/MVPE ratio of 1.42 was added in amounts of 2 percent by weight and 5 percent by weight, respectively. In any case of the amounts, the elongation difference of the blended yarn was insufficient, and the touch of the woven fabric was a level worthless for the commercialization of the woven fabric. Further, Comparatives 16, 17 are examples in which the polystyrene having a melt viscosity MVPS of 5,000 poise and an MVPS/MVPE ratio of 3.57 was used. In Comparative example 16 in which the amount of the added polystyrene was small, the elongation difference of the blended yarn was not developed, and the touch of the woven fabric was a level worthless for the commercialization of the woven fabric. On the other hand, in Comparative example 17 in which the amount of the added polystyrene was too large, the elongation difference of the blended yarn was sufficiently developed, and the touch of the woven fabric was good, but the spun yarn breakage and the textured yarn breakage frequently happened to lower the productivity.

Utilization in Industry

The polyester blended yarn having a high elongation difference between constituting filaments and having excellent bulkiness can stably be produced at a low cost by the production method of the present invention. Further, a fabric exhibiting a high-grade texture is obtained from the blended yarns produced by the above-mentioned first method. In addition, by the above-mentioned third method, the polyester blended yarn having excellent false-twistability can be produced, and a fabric rich in bulkiness and softness is obtained from the blended yarns. Thereby, by the production methods of the present invention, the products having high added values can be produced, while controlling factors causing the increase of the costs, and such the production methods have extremely high industrial values.

We claim:

1. A method for producing a polyester blended yarn, characterized by melt-extruding a polyester composition A which comprises a substrate polymer comprising a polyester and 0.5 to 5.0 percent by weight of a polymer P different from the substrate polymer, and the substrate polymer from an identical spinneret or different spinnerets, respectively, to obtain the filament group A comprising the polyester composition A and the filament group B comprising the substrate polymer, once separately cooling and solidifying the filament groups, blowing the cooling air on the filament group B at a speed (BSb) of 0.20 to 0.80 m/sec and the cooling air on the filament group A at a speed (ASb) of not less than 1.1 times the speed (BSb), respectively, doubling the filament groups, and then taking off the obtained blended yarn at a speed of not less than 2,500 m/mm.

2. The method for producing the polyester blended yarn according to claim 1, wherein the distances (AZa, AZb) between the spinneret extrusion faces and the cooling air blowing start positions for the filament groups A, B, respectively, satisfy the following expression (3) $AZa<0.8\times AZb$.

3. The method for producing the polyester blended yarn according to claim 1 or 2, wherein the polymer P is a polymethyl methacrylate-based polymer and/or a polystyrene-based polymer.

4. A method for producing a polyester blended yarn, characterized by doubling a filament group A obtained by adding a polymer P to a substrate polymer comprising a polyester and then melting, blending and spinning the mixture with a filament group B comprising the substrate polymer and spun from the same spinneret or a different spinneret and then winding up the obtained blended yarn, characterized by disposing a bundling device for bundling the filament group A at the distance GA that is more than GO and not more than 200 cm, wherein GO is a distance between the spinneret face and the necking-starting point of the filament group A, and GA is a distance between the spinneret face for spinning the filament group A and the bundling device.

5. The method for producing the polyester blended yarn according to claim 4, wherein the polymer P is a polymethyl methacrylate-based polymer and/or a polystyrene-based polymer.

6. The method for producing the polyester blended yarn according to claim 4 or 5, wherein the amount of the added polymer P is in a range from 0.3 to 5.0 percent by weight based on the substrate polymer.

7. The method for producing the polyester blended yarn according to claim 4, wherein the range of the fineness of the filament group A after being spun and wound up is 50 to 300 dtex.

8. The method for producing the polyester blended yarn according to claim 4, wherein the spinning and winding speed is not less than 2,000 m/min.

9. A method for producing a polyester blended yarn, characterized by once cooling a filament group A obtained by adding a polymethyl methacrylate-based polymer having a melt viscosity MVPM (poise) of not less than 0.6 times a melt viscosity MVPE (poise) of the following polyester and/or a polystyrene-based polymer having a melt viscosity MVPS (poise) of not less than 1.5 times MVPE (poise) in an amount of 0.3 to 5.0 percent by weight based on a substrate polymer comprising the polyester to the substrate polymer, and then blending, melting and spinning the mixture and a filament group B comprising said substrate polymer spun from the same spinneret or a different spinneret at temperatures equal to or lower than the glass transition temperatures, doubling the cooled filament groups A and B, and then winding up the obtained blended yarn.

* * * * *